United States Patent [19]

Kanno et al.

[11] Patent Number: 4,721,474

[45] Date of Patent: Jan. 26, 1988

[54] HIGH TENSION FEEDING CABLE AND A METHOD OF MANUFACTURING THE SAME

[75] Inventors: Toshiaki Kanno; Masahiro Kanda, both of Gotenba, Japan

[73] Assignee: Yazaki Corporation, Japan

[21] Appl. No.: 906,293

[22] Filed: Sep. 11, 1986

[30] Foreign Application Priority Data

Sep. 11, 1985 [JP] Japan ..... 60-199310

[51] Int. Cl.[4] ..... H01R 13/514; H01R 43/00

[52] U.S. Cl. ..... 439/125; 439/750; 29/858; 29/869

[58] Field of Search ..... 339/26, 218, 211, 213, 339/213 S, 218 S; 29/857, 858, 869, 868, 871; 439/125, 425, 736, 750

[56] References Cited

U.S. PATENT DOCUMENTS

| | | | |
|---|---|---|---|
| 2,225,728 | 12/1940 | Weidenman, Jr. | 339/218 |
| 2,648,030 | 8/1953 | Kiekhaefer | 339/26 |
| 3,594,696 | 7/1971 | Witek, Jr. | 339/218 R |
| 3,867,001 | 2/1975 | Hedman | 339/26 |
| 4,274,695 | 6/1981 | Fukumori et al. | 339/213 S |

*Primary Examiner*—Gil Weidenfeld
*Assistant Examiner*—Daniel W. Howell
*Attorney, Agent, or Firm*—Wigman & Cohen

[57] ABSTRACT

A high tension feeding cable, includes:

a body of cable which has a high tension core for supplying a high tension current, and an inner covering layer provided on the outer surface of said high tension core, cylindrical terminals, attached to said cable body, for connecting the high tension core to mating electrical apparatus, said cylindrical terminal having a connecting section which connects the inside and outside of the cylinder, said cylindrical terminal being attached to said cable body so as to have the connecting section positioned in the neighborhood of the end surface position of said cable body, and terminal caps, provided on the end sections of the body of cable with the cylindrical terminal, for protecting said cylindrical terminals and further for connecting the high tension feeding cable mechanically to mating electrical apparatus. The terminal caps have (i) a surrounding section that surrounds at least a part of said cylindrical terminal and cable body, and (ii) a projected section that projects from the outside surface to the inside surface of the cylinder through the connecting section in said cylindrical terminal.

The high tension feeding cable eliminates positional slippage of the connecting terminal and the terminal caps with respect to the cable body.

8 Claims, 11 Drawing Figures

HIGH TENSION FEEDING CABLE AND A METHOD OF MANUFACTURING THE SAME

The present invention relates to a high tension feeding cable, and more particularly to an ignition cable for supplying a high voltage to ignition plugs of motor vehicles or the like.

DESCRIPTION OF THE PRIOR ART

High tension cables for noise prevention are used in various instruments such as ignition cables and other electrical equipment. FIGS. 1 and 2 show an example of ignition cables; the cable basically comprises a body of cable 1, connecting terminals 6,6' which connect the cable 1 to a distribution tower or coil tower, and terminal caps 7,7' which cover the insulating section. The body of cable 1 consists of a nonmetallic conductor 2, insulating covering 3, glass fiber braiding 4 and a sheath 5.

Now, the ignition cable is manufactured as follows. First, nonmetallic conductor 2 is exposed by removing the end sections of insulating covering 3, glass fiber braiding 4, and sheath 5 from the cable body 1. Then the conductor 2 is folded over the covering layer. The connecting terminal 6 that has, for example, a cylindrical section 6*a* and a wire connecting section 6*b* for fitting the cable to the ignition plug, is attached under pressure to be fixed to the wire. Then, the voltage-withstanding and insulating terminal cap 7 which is adapted to be attached to the insulator section of the ignition plug is placed to cover the connecting terminal 6. The joining section of the terminal cap 7 and the cable body 1 is then fixed with an adhesive. Further, with similar procedure, the other end of the cable body 1 is covered with a connecting terminal 6'0 and a terminal cap 7'. In the assemblage of this kind, coverings 9 and 9' made of an insulator or a conductor are sometimes provided for the ends of the conductor 2 which is exposed to the interior of the connecting terminals 6 and 6', to prevent the burning of the conductor 2 due to direct discharge.

However, in such a prior-art ignition cable, the connecting terminal cap 7,7' is fixed to the covering of the wire only with the adhesive 8, so that, as the connecting terminal is used for joining and disjoining an increasing number of times, there are generated detachments in the glued section 8, resulting in leakage or flash over, and the attachment of the connecting terminal cap 7,7' becomes insecure due to slipping-off of the connecting terminal cap 7,7'. In addition, if it is attempted to increase the length of the glued section to prevent such accidents, a longer cable is required.

Moreover, since connecting terminals 6,6' of the cable are fixed to the wire merely by pressing them to insulating covering, the construction has the defect that the connecting terminals tend to drop out of place even under a small tension. However, if the outer diameter of the wire is increased to prevent such a slippage, there are generated problems not only that the reliability of attachment under pressure of the connecting terminals is decreased but also that the work for attaching the connecting terminals cap becomes complicated.

SUMMARY OF THE INVENTION

The general object of the present invention is to provide a high tension feeding cable which can overcome the above defects that existed in the prior-art high tension feeding cable.

A more specific object of the present invention is to provide a high tension feeding cable which eliminates positional slippage of the terminal caps with respect to the cable body.

A further object of the present invention is to provide a high tension feeding cable which eliminates a dropping-out of the connecting terminals from the cable body.

A still further object of the present invention is to provide a high tension feeding cable which has an extremely good insulation durability against high tension.

Another object of the present invention is to provide a high tension feeding cable which does not give rise to corona discharges or the like at the end regions so as not to generate such troubles as flash over or leakage, and hence has a high reliability.

Still another object of the present invention is to provide a high tension feeding cable whose electrostatic capacity decreases and whose output voltage is raised in response to said decrease.

In order to achieve the above objects, the high tension feeding cable of the present invention, comprises:

(a) a body of cable which comprises a high tension core supplying a high tension current, and an inner covering layer provided on the outer surface of said high tension core.

(b) cylindrical terminals, attached to said cable body, for connecting the high tension core to mating electrical apparatus, said cylindrical terminal having a connecting section which connects the inside and outside of the cylinder, said cylindrical terminal being attached to said cable body so as to have the connecting section positioned in the neighborhood of the end surface position of said cable body, and (c) terminal caps provided on the end sections of the body of cable with the cylindrical terminal, for protecting said cylindrical terminals and further for connecting the high tension feeding cable mechanically to mating electrical apparatus, said terminal cap comprising (i) a surrounding section that surrounds at least a part of said cylindrical terminal and cable body, and (ii) a projected section that projects from the outside surface to the inside surface of the cylinder through the connecting section in said cylindrical terminal.

Further, the method of manufacturing the high tension feeding cable of the present invention that can achieve the above objects comprises the steps of:

(a) producing the cable body which comprises a high tension core supplying a high tension current, and an inner covering layer provided on the outer surface of the high tension core, (b) attaching a cylindrical terminal, which has in a side surface a connecting section that connects the inside surface of the cylinder with its outside surface, to each end section of the cable body, in such a way as to have said connecting section in the cylindrical terminals to be positioned in the neighborhood of the end surface position of the cable body, and (c) forming at least terminal caps at the ends of cable, said forming step including the steps of, (i) positioning the pre-processed body obtained at step (b) in the inside of a mold that has a cavity for forming terminal caps, (ii) injecting a molding agent into the mold, and (iii) hardening said molding.

These and other objects, features and advantages of the present invention will be more apparent from the following description of the preferred embodiments, taken in conjunction with the accompanying drawings.

DESCRIPTION OF THE PREFERRED EMBODIMENTS

Figure 1:
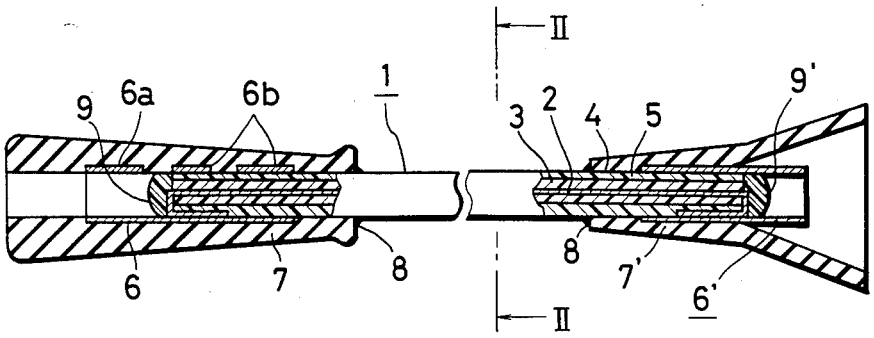
FIG.1 PRIOR ART
FIGS. 1 and 2 show a longitudinal sectional view and a transverse sectional view, respectively, of a prior-art high tension feeding cable.
Figure 2:
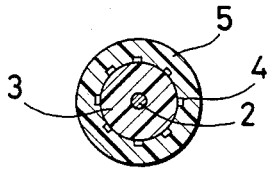
FIG.2 PRIOR ART
Figure 3:
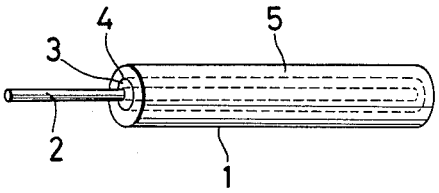
FIG. 3 shows a perspective view of an embodiment of the cable body of the high tension feeding cable in accordance with the present invention.

Referring to FIG. 3, the body of cable 1 which is used for manufacturing a high tension feeding cable in accordance with the first embodiment of the present invention is obtained by covering the outside of a core 2, made of such material as a conductive plastic and reinforced with fibers or the like, with an insulating covering 3 made of highly insulating heat-resistance synthetic rubber, then by providing a braid 4 of glass fiber or the like, and further, covering the entire assembly with a sheath 5 made of synthetic rubber or soft plastic.

It is to be noted that the insulating covering 3, the braid 4, and the sheath 5 constitute an inner covering layer.

Figure 4:
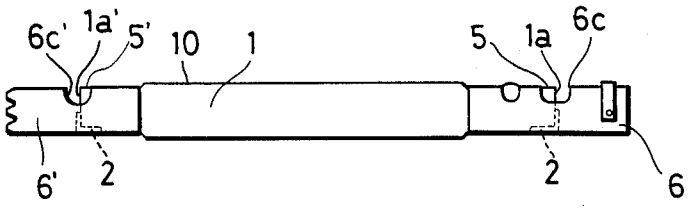
FIG. 4 shows a side view of a pre-processed body which is obtained by attaching cylindrical terminals and other members to the cable body.

Referring to FIG. 4, on both ends of the cable body 1, there are attached cylindrical terminals 6 and 6'. Namely, after removing the inner covering layer on the end sections of the cable body 1 and folding the high tension core 2 back over the surface of the sheath 5, the cylindrical terminals 6 and 6' for connecting the cable to the high tension terminal such as an ignition plug or a coil tower, are fitted to the cable body. In this case, the cylindrical terminals 6 and 6' are attached under pressure to the high tension core so that the terminals 6,6' can be connected securely to the core 2, 2 electrically. In addition, the cylindrical terminals 6 and 6' have, for a purpose to be described later, through holes (connecting sections) 6c and 6c' that connect the outer surface of the cylinder to the inner surface of the same. Here, the cylindrical terminals 6 and 6' are fitted to the cable body 1 in such a way as to have the through holes 6c and 6c' positioned at the locations of the end surfaces of the cable body 1.

Next, a silicon resin primer is spread on the outer surface of the assembled body thus obtained and, as needed, on the end surfaces 1a and 1a' of the cable body that are exposed to the inside of the cylindrical terminals 6 and 6'. The primer is then hardened. The resin film 10 thus obtained increases the adhesive power between an outer cover layer 11 for insulation that is provided on top of the resin film 10 and the sheath 5 of the cable body 1. The appropriate thickness of the film 10 is about 0.1 mm, and it is not necessary to have a thickness of more than 1 mm even if the thickness is large.

Figure 5:
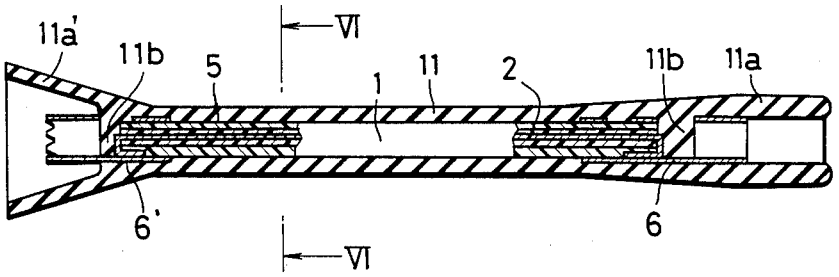
FIGS. 5 and 6 show a longitudinal sectional view and a transverse sectional view, respectively, of the first embodiment of the present invention.

A pre-processed body obtained in this manner is set in a mold for forming the cable. The mold has on its both ends, attaching sections to which can be fitted cylindrical terminals 6 and 6', and also has a cavity on its periphery for molding terminal caps 11a and 11a' as shown in FIG. 5. In addition, the mold is of a shape that has a gap space for forming the outer insulating covering layer 11 around the cable body 1, and may have a heating means (not shown) depending upon the need. Needless to say, the caps 11a and 11a' are molded in such shapes that can be contacted closely to the insulator sections of the high tension terminals of the mating apparatus to which the cable is connected.

Figure 6:
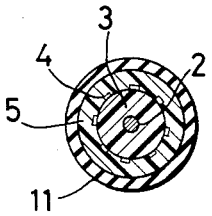

Next, liquid silicon rubber of addition reaction type is injected to be hardened to the gap between the mold and the pre-processed body. The liquid rubber used for this purpose has a viscosity of 10 to 50,000 poise, and is pressurized and heated as need arises. In so doing, a part of the silicon rubber flows to the inside of the cylindrical terminals 6,6' via the through holes 6c and 6c' that are provided on the side of the cylindrical terminals 6 and 6', to form protrusions 11b and 11b' that cover the side surfaces 1a and 1a' of the cable body 1. The configuration of the high tension feeding cable of the present invention obtained in this way is as shown in FIG. 5 and FIG. 6.

Next, referring to FIG. 7 to FIG. 10, concrete example that incorporates the embodiment in the foregoing and the test results of its performance will be described.

An assembled body as shown in FIG. 4 was obtained by attaching under pressure cylindrical terminals made of SUS 434 to both ends of the cable body 1 having a sheath 5 of outer diameter of 7 mm and length of 100 mm. Next, two-liquid type silicon resin primer (commercial name X, Y Primer made by Toray Silicon Company) was spread over the outer surface of the terminals 6,6' and the outer surface of the cable body 1. After drying at room temperature for 24 hours, the sheathed, primed, pre-processed body was set in a mold described earlier, and three kinds of addition reaction type liquid silicon rubber listed below were injected to be molded by hardening, to obtain high tension feeding cable A, B, and C having an outer diameter of 8 mm for the wire portion.

| | Silicon Rubber Used | |
|---|---|---|
| Sample | Viscosity (poise) | Maker and Commercial Name |
| A | 430 | Toshiba Silicon: XE 14-301 |
| B | 1100 | Toray Silicon: DX 35-054 |
| C | 6300 | Shin etsu Chemical: X 34-016 |

Various kinds of performances given below were tested for the high tension feeding cable thus obtained.

(1) Joining Force between Cable and Terminal Cap

Figure 7:
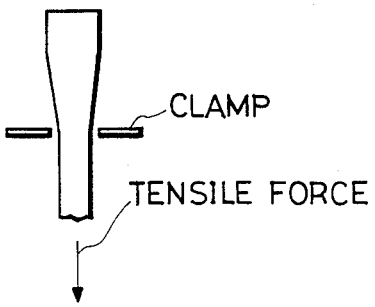
FIGS. 7 and 8 show an explanatory diagram of the tension test and the graph for the test result, respectively, of the uniting force between the cable body and the terminal cap for the first embodiment of the high tension feeding cable.
Figure 8:
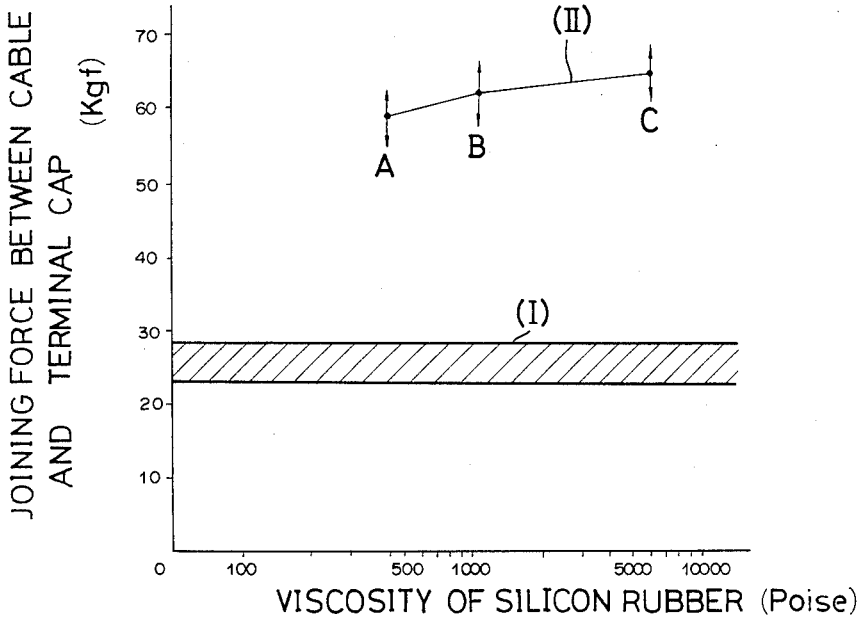

Breakdown strength (kgf) of the high tension feeding cable to be tested was measured by the clamping method as shown in FIG. 7 by mounting the sample on the tension testing machine and pulling it at the speed of 200 mm/min. The result of the test, given as the average value and the spread for 10 samples in accordance with the present invention, is shown as the curve (II) in FIG. 8, together with the control limits (I) for the existing cables.

From the result, it will be seen that the products according to the present invention are stronger by over 30 kgf than the existing products, that is, they have a strength more than twice that of the prior-art products.

(2) Spark Endurance

Figure 9:
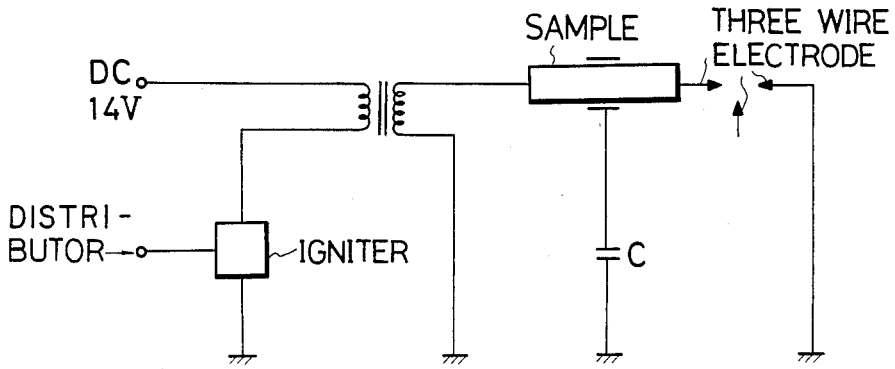
FIGS. 9 and 10 are a circuit diagram for a spark endurance testing apparatus and the test result, respectively, for testing the insulation durability of the first embodiment of the high tension feeding cable.
Figure 10:
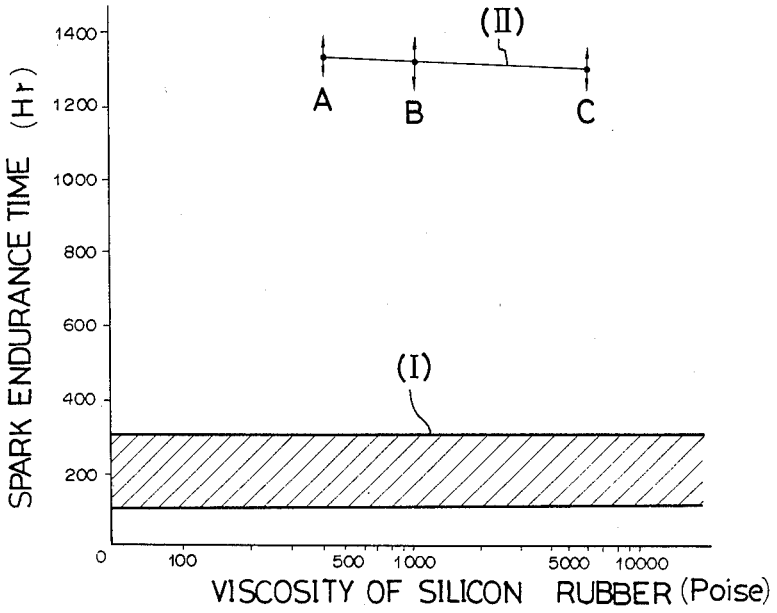

The spark endurance time was measured under the conditions of 25 kVp and 6000 pulse/min by using a testing apparatus that has a circuit as shown in FIG. 9. The result of the tests is shown in FIG 10 in which the average value and the spread for 5 samples in accordance with the present invention are shown as (II) and the control limits for the prior-art products are shown as (I).

From the result, it will be seen that the products in accordance with the present invention have a spark endurance of more than 4 times that of the prior-art products.

(3) Electrostatic Capacity of the Cable

The electrostatic capacity between the core and the surface of the cable was measured at 1 kHz by the use of the multi-frequency LCR meter made by Yokogawa-Hewlett Packard Company.

In addition, secondary output voltage at the end of the cable for a breaking current on the primary side of 5A was measured by the use of an apparatus similar to the apparatus used for the spark endurance measurement. The results of these tests are summarized in Table 1.

From the results in will be seen that, compared with the prior-art products, the products in accordance with the present invention have smaller electrostatic capacity and larger output voltage.

TABLE 1

| Sample | Electrostatic Capacity pF/m | Secondary Output Voltage kVp |
|---|---|---|
| A | 111 | 42.9 |
| B | 108 | 43.0 |
| C | 109 | 43.0 |
| Prior-Art Product | 129 | 41.8 |

Figure 11:
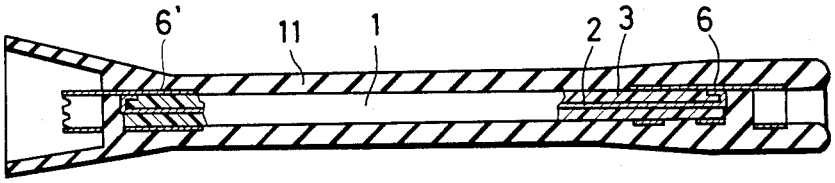
FIGS. 11 shows a longitudinal sectional view of another embodiment of the high tension feeding cable of the present invention.

Next, referring to FIG. 11, a second embodiment of the present invention will be described. A high tension feeding cable with outer diameter of a 7 mm for the wire section was obtained in a manner similar to the first embodiment, except that use was made of a cable body 1 with outer diameter of 4.8 mm that has EPDM as insulating covering 3 but has neither braid nor sheath. Compared with the prior-art products that have outer diameter of 7 mm for the wire section, it was confirmed that this cable also exhibits sharply defined improvements both in the joining force between the cable and the terminal cap and in the spark durability.

As described in detail in the foregoing, according to the present invention, troubles such as dropping-out of the terminal and slippage of the terminal cap will not arise, and accidents such as flash over and leakage will not occur. In addition, corona discharge at the end sections or the like will not be generated and a high tension feeding cable with high reliability can be obtained, with the result of simplifying the maintenance and inspection of the cable.

Further, short cables and thick cables can be obtained easily without modifying the specifications of the component parts and other elements of the assembly, which makes it possible to further decrease the loss of the transmitted energy.

Although the invention has been described in its preferred embodiments, it is to be understood that various changes and modifications may be made within the purview of the appended claims without departing from the true scope and spirit of the invention in its broader aspects.

What is claimed is:

1. A high tension feeding cable, comprising:

(a) a body of cable which comprises a high tension core for supplying a high tension current, and an inner covering layer provided on the outer surface of said high tension core, (b) cylindrical terminals, attached to the ends of said cable body, for connecting the high tension core to mating electrical apparatus, said cylindrical terminals having a connecting section which connects the inside and outside of the cylindrical terminals, said cylindrical terminals being attached to said cable body so as to have the connecting sections positioned in the neighborhood of the end surface positions of the ends of said cable body, and (c) terminal caps, provided on the end sections of the body of cable with the cylindrical terminal, for protecting said cylindrical terminals and further for connecting the high tension feeding cable mechanically to mating electrical apparatus, said terminal caps comprising (i) a surrounding section that surrounds at least a part of said cylindrical terminal and cable body, and (ii) a projected section that projects from the outside surface to the inside surface of the cylindrical terminal through the connecting section in said cylindrical terminal;

wherein, on the outer periphery of said cable body, there is provided an outer covering layer which substantially covers the cable body in its entire length, and in addition, is molded in a united body with said terminal caps on both ends of the cable body.

2. The high tension feeding cable as claimed in claim 1, wherein said terminal caps and the outer covering layer are molded from addition reaction type liquid silicon rubber.

3. The high tension feeding cable as claimed in claim 2, wherein said addition reaction type liquid silicon rubber possesses a viscosity of 10 to 50,000 poise.

4. A high tension feeding cable, comprising:

(a) a body of cable which is obtained by providing an inner covering layer on the outer surface of a core;

(b) terminals that are attached on respective ends of said cable body;

(c) adhesive resin which is provided continuously on the outer surface of said cable body and the outer surface of said terminals; and (d) an outer covering layer which is provided closely adhered to the outer surface of said adhesive resin, said outer covering layer being molded in a united body with terminal caps for mechanically connecting said cable body to mating electrical apparatus.

5. A process for producing a high tension feeding cable, comprising the steps of:

(a) producing a cable body which comprises a high tension core for supplying a high tension current, and an inner covering layer provided on the outer surface of the high tension core, (b) attaching connecting terminals on both ends of the cable body, (c) spreading and hardening an adhesive resin on a part of the outer surface of the cable body and the outer surface of the connecting terminals, and if required, on the end surface of the cable body to obtain a pre-processed body, (d) positioning the pre-processed body thus obtained in the inside of a mold which has a cavity for forming terminal caps to be used for connecting the cable body to mating electrical apparatus, and (e) injecting an addition reaction type liquid silicon rubber that has a viscosity of 10 to 50,000 poise into the mold and hardening said liquid silicon rubber in the mold.

6. The process according to claim 5, wherein the adhesive resin is obtained from silicon resin primer.

7. A high tension feeding cable, comprising:

(a) a body of cable which is obtained by providing an inner covering layer on the outer surface of a core;

(b) terminals that are attached on respective ends of said cable body;

(c) adhesive resin which is provided continuously on the outer surface of said cable body and the outer surface of said terminals; and (d) an outer covering layer which is provided closely adhered to the outer surface of said adhesive resin, said outer covering layer being molded in a united body with terminal caps for mechanically connecting said cable body to mating electrical apparatus;

wherein said terminal caps and the outer covering layer are molded from addition reaction type liquid silicon rubber.

8. A high tension feeding cable, comprising:

(a) a body of cable which is obtained by providing an inner covering layer on the outer surface of a core;

(b) terminals that are attached on respective ends of said cable body;

(c) adhesive resin which is provided continuously on the outer surface of said cable body and the outer surface of said terminals; and (d) an outer covering layer which is provided closely adhered to the outer surface of said adhesive resin, said outer covering layer being molded in a united body with terminal caps for mechanically connecting said cable body to mating electrical apparatus;

wherein said terminal caps and the outer covering are molded from addition reaction type silicon rubber which possesses a viscosity of 10 to 50,000 poise.

* * * * *